US011683648B2

(12) United States Patent
Badillo et al.

(10) Patent No.: US 11,683,648 B2
(45) Date of Patent: Jun. 20, 2023

(54) ACOUSTIC MICROPHONE WITH INTEGRATED MAGNETIC TRANSDUCER

(71) Applicant: Knowles Electronics, LLC, Itasca, IL (US)

(72) Inventors: Dean Badillo, Schaumburg, IL (US); Christopher Jones, Carpentersville, IL (US); Christopher Monti, Elgin, IL (US); Usha Murthy, Naperville, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 2 days.

(21) Appl. No.: 17/071,029

(22) Filed: Oct. 15, 2020

(65) Prior Publication Data

US 2021/0112344 A1 Apr. 15, 2021

Related U.S. Application Data

(60) Provisional application No. 62/915,614, filed on Oct. 15, 2019.

(51) Int. Cl.
*H04R 9/08* (2006.01)
*H04R 1/08* (2006.01)

(52) U.S. Cl.
CPC ..... *H04R 9/08* (2013.01); *H04R 1/08* (2013.01); *H04R 2201/003* (2013.01)

(58) Field of Classification Search
CPC ..... H04R 25/554; H04R 9/025; H04R 9/08; H04R 25/00; H04R 19/04; H04R 2225/51; H04R 1/08; H04R 1/10; H04R 2201/003; H04R 2209/024; H04R 15/00; H04R 2410/00; H04R 25/55
USPC ..... 381/177, 312, 355, 412, 396, 400, 420, 381/122, 115, 91
See application file for complete search history.

(56) References Cited

U.S. PATENT DOCUMENTS

| | | | |
|---|---|---|---|
| 3,396,245 | A | 8/1968 | Flygstad |
| 4,596,899 | A | 6/1986 | Wojcik et al. |
| 5,195,142 | A | 3/1993 | D'Avolio et al. |
| 6,466,679 | B1 | 10/2002 | Husung |
| 6,694,034 | B2 | 2/2004 | Julstrom et al. |
| 7,260,234 | B2 | 8/2007 | Kasztelan et al. |
| 8,553,918 | B2 | 10/2013 | Kasztelan et al. |

(Continued)

FOREIGN PATENT DOCUMENTS

EP 2661061 A2 * 11/2013 ..... H04M 1/6058

OTHER PUBLICATIONS

Sterkens, Juliette; Adjusting Telecoils for Use in Hearing Loops & More; New Mexico Hearing Loss Technology Conference; 2018.

*Primary Examiner* — Norman Yu

(57) ABSTRACT

A microphone assembly includes a housing including a sound port and an external-device interface having a plurality of electrical contacts. An acoustic transducer, such as a MEMS microphone, is disposed in the housing and is in acoustic communication with the sound port. An electrical circuit is disposed in the housing that is electrically coupled to the acoustic transducer and to electrical contacts on the external-device interface. A magnetic transducer including an electrical coil disposed about a core, such as a telecoil or charging coil configuration, is fastened to the housing. The electrical coil having leads, at least one of the leads electrically terminated at a coil contact of the housing.

15 Claims, 14 Drawing Sheets

(56) References Cited

U.S. PATENT DOCUMENTS

| | | | | |
|---|---|---|---|---|
| 9,485,592 | B2 | 11/2016 | Riepenhoff | |
| 2003/0031339 | A1* | 2/2003 | Marshall | H01Q 1/27 381/400 |
| 2005/0111681 | A1* | 5/2005 | Essabar | H04B 5/02 381/315 |
| 2006/0133633 | A1 | 6/2006 | Hyvonen et al. | |
| 2007/0104343 | A1* | 5/2007 | Bengtsson | H04R 25/305 381/323 |
| 2007/0242845 | A1* | 10/2007 | Westermann | H04R 25/658 381/330 |
| 2008/0212812 | A1 | 9/2008 | Chan et al. | |
| 2008/0304685 | A1* | 12/2008 | Fideler | H04R 25/604 381/323 |
| 2009/0046879 | A1 | 2/2009 | Knudsen et al. | |
| 2009/0214064 | A1 | 8/2009 | Wu et al. | |
| 2013/0295850 | A1* | 11/2013 | Klinghult | H04R 25/43 455/41.3 |
| 2014/0103464 | A1* | 4/2014 | Bolognia | H04R 1/04 257/416 |
| 2018/0054681 | A1* | 2/2018 | Woods | H04R 25/43 |

* cited by examiner

ACOUSTIC MICROPHONE WITH INTEGRATED MAGNETIC TRANSDUCER

RELATED APPLICATIONS

This application claims priority to U.S. Provisional Patent Application Ser. No. 62/915,614 filed on Oct. 15, 2019, entitled "Acoustic Microphone with Integrated Magnetic Transducer," the entire contents of which are hereby incorporated by reference.

FIELD OF THE DISCLOSURE

The present disclosure relates generally to microphone assemblies and more particularly to microphones integrated with magnetic transducers, hearing devices with such microphone assemblies, and methods therefor.

BACKGROUND

Some hearing devices and cochlear implants include an integrated antenna or telecoil that receives audio input from a non-acoustic source. Telecoil-equipped hearing aids were originally designed to receive audio input via magnetic coupling with a telephone receiver for improved sound performance during telephone use. The user of the hearing device would typically disable the microphone during telecoil use. Some such hearing devices are also capable of receiving audio input from assistive listening systems of the type having an induction loop that emits a wireless audio signal received by the telecoil. Revisions to the Americans with Disabilities Act (ADA) now require that certain venues and public spaces having amplified sound systems be equipped with assistive listening systems. Electrical coils also find use for wireless charging and noise cancellation in hearing devices. Users of medical and non-medical hearing devices alike can thus benefit from improvements in magnetic transducers.

The various aspects, features and advantages of the present disclosure will become more fully apparent to those having ordinary skill in the art upon consideration of the following Detailed Description and the accompanying drawings described below.

BRIEF DESCRIPTION OF THE DRAWINGS

The disclosure is described in more detail below in connection with the appended drawings and in which like reference numerals represent like components.

DETAILED DESCRIPTION

According to one aspect of the disclosure, a microphone assembly comprises generally a magnetic transducer including an electrical coil disposed about a core, wherein the magnetic transducer is fastened to a housing of the microphone assembly. In one implementation, the electrical coil of the magnetic transducer is disposed or wound about a portion of the housing of the microphone assembly. In another implementation, the electrical coil of the transducer is fastened to the housing but is not wound about the housing.

In embodiments where the magnetic transducer is configured as a telecoil, the core has a medium or high magnetic permeability. In implementations where the electrical coil of the magnetic transducer is disposed about a portion of the housing, the housing portion has a medium or high magnetic permeability. In other implementations, the electrical coil is disposed about a medium or high magnetically permeable core coupled to the housing of the microphone assembly.

In embodiments, where the magnetic transducer is configured as a wireless charging coil, the core does not require a medium or high magnetic permeability. Thus, in implementations where the electrical coil of the magnetic transducer is disposed about a portion of the microphone assembly housing, the housing portion need not have a medium or high magnetic permeability. Similarly, in implementations where the electrical coil is fastened to a portion of the housing, but not wound thereabout, the core of the electrical coil need not have a medium or high magnetic permeability. For example, the core could be air core or some other material with a low magnetic permeability.

Figure 3:
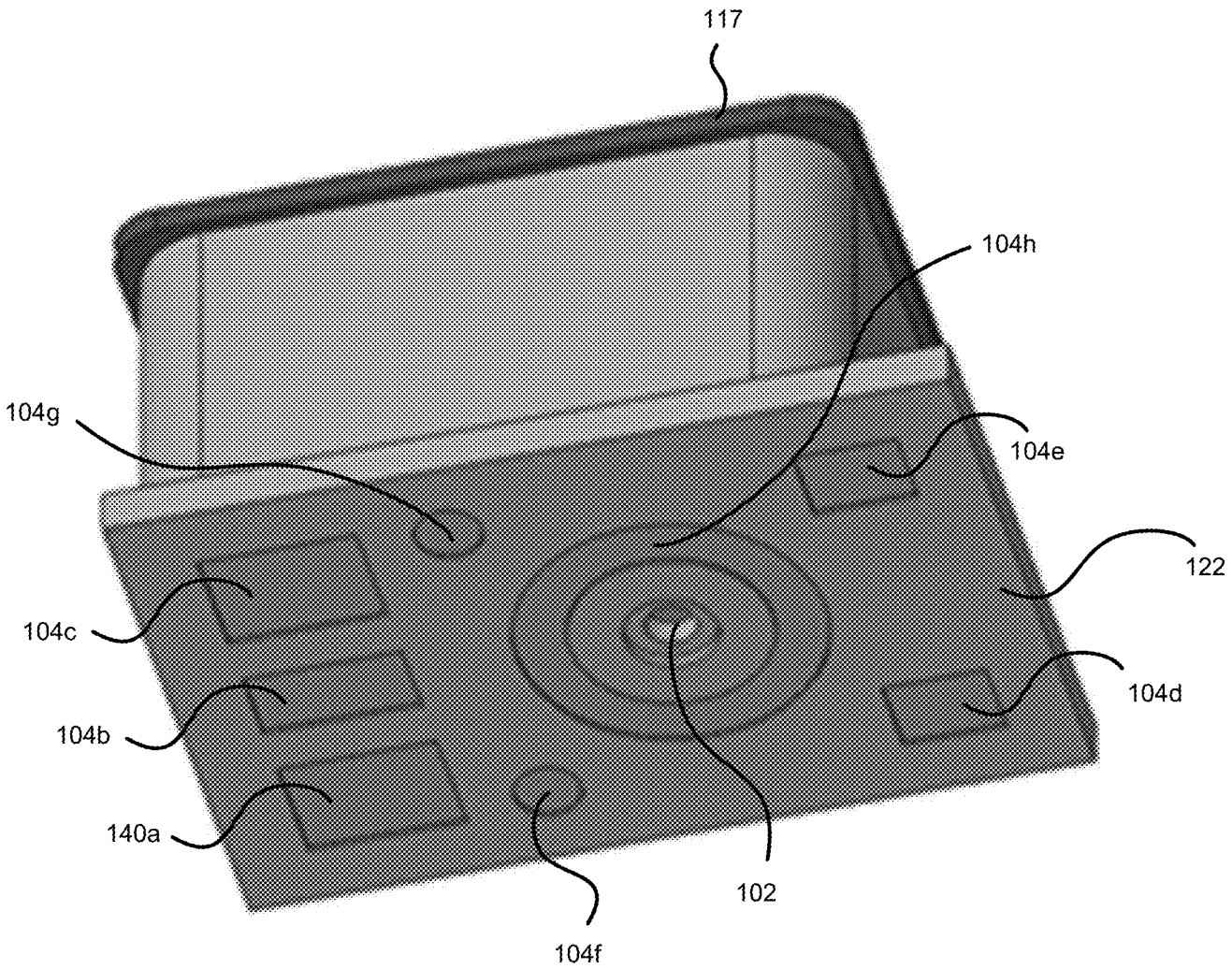
FIG. 3 is another perspective view of the microphone assembly of FIG. 1.

The microphone assembly housing generally comprises a sound port and an external-device interface having a plurality of electrical contacts. In one implementation, the external-device interface is a surface-mount interface suitable for integrating the microphone assembly to a host device, for example by reflow or wave soldering or some other known or future surface-mount technology. In one embodiment, the housing includes a base and a can (also referred to as a cover or lid) coupled to a first surface of the base, wherein the external-device interface is disposed on a second surface of the base opposite the first surface. In FIG. 3, the external-device interface includes a plurality of electrical contacts 104*a*-104*g* for a supply voltage, ground, output signal, clock, data, as well as terminals for the magnetic transducer. Contacts arranged differently or for other signals may be used alternatively. For example, magnetic transducer contacts may not be required where the magnetic transducer output is coupled to an electrical circuit of the microphone assembly as described further herein. The base is a printed circuit board (PCB) material like FR-4 or some other known or future material suitable for use in microphone assemblies. The can is a metal, plastic, FR-4 or other material suitable for microphone assemblies. A metal EMI (electromagnetic interference) shield is typically applied to non-metal cans. Similarly, a plating of high conductivity metal, such as gold, is frequently applied to metal cans to improve the EMI susceptibility or radiated EMI of the assembly or both. Other metallic coatings may also be applied to cans to improve the solderability of the can, for example.

Figure 1:
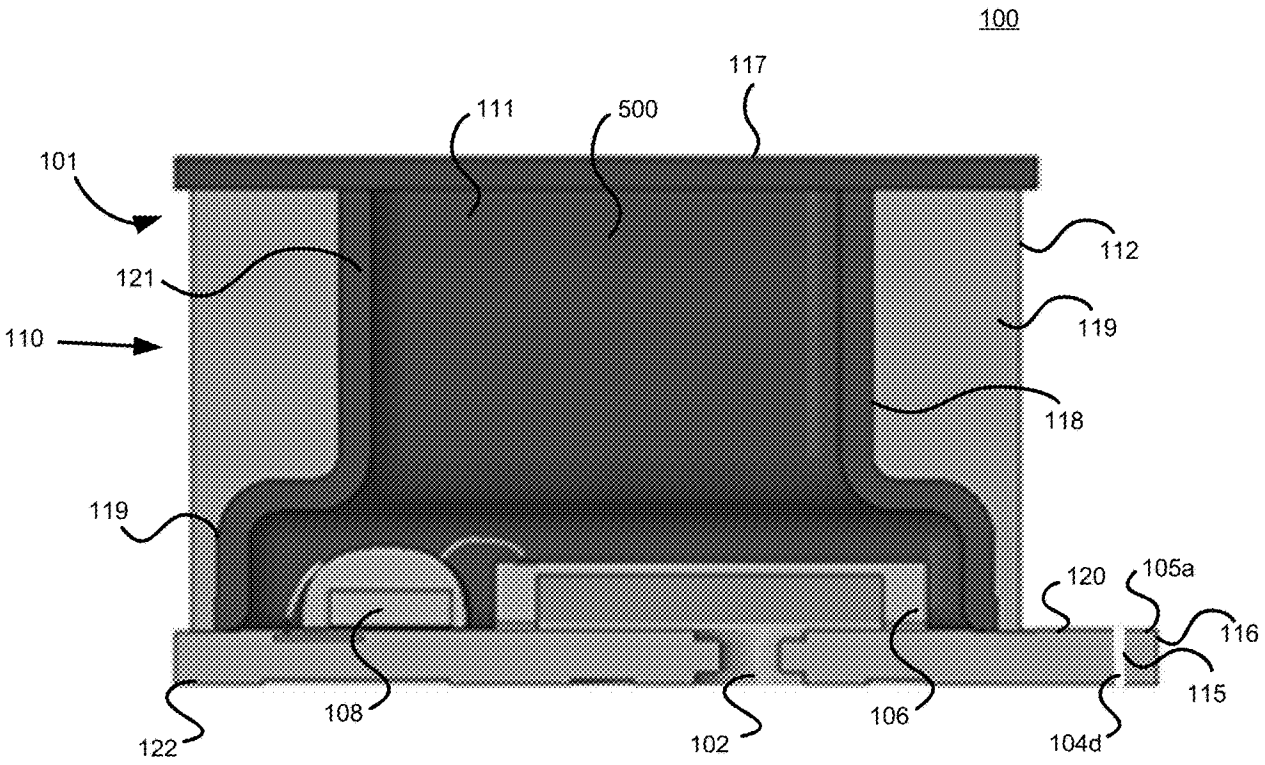
FIG. 1 is a cross-sectional view of the microphone assembly of FIG. 2.
Figure 4:
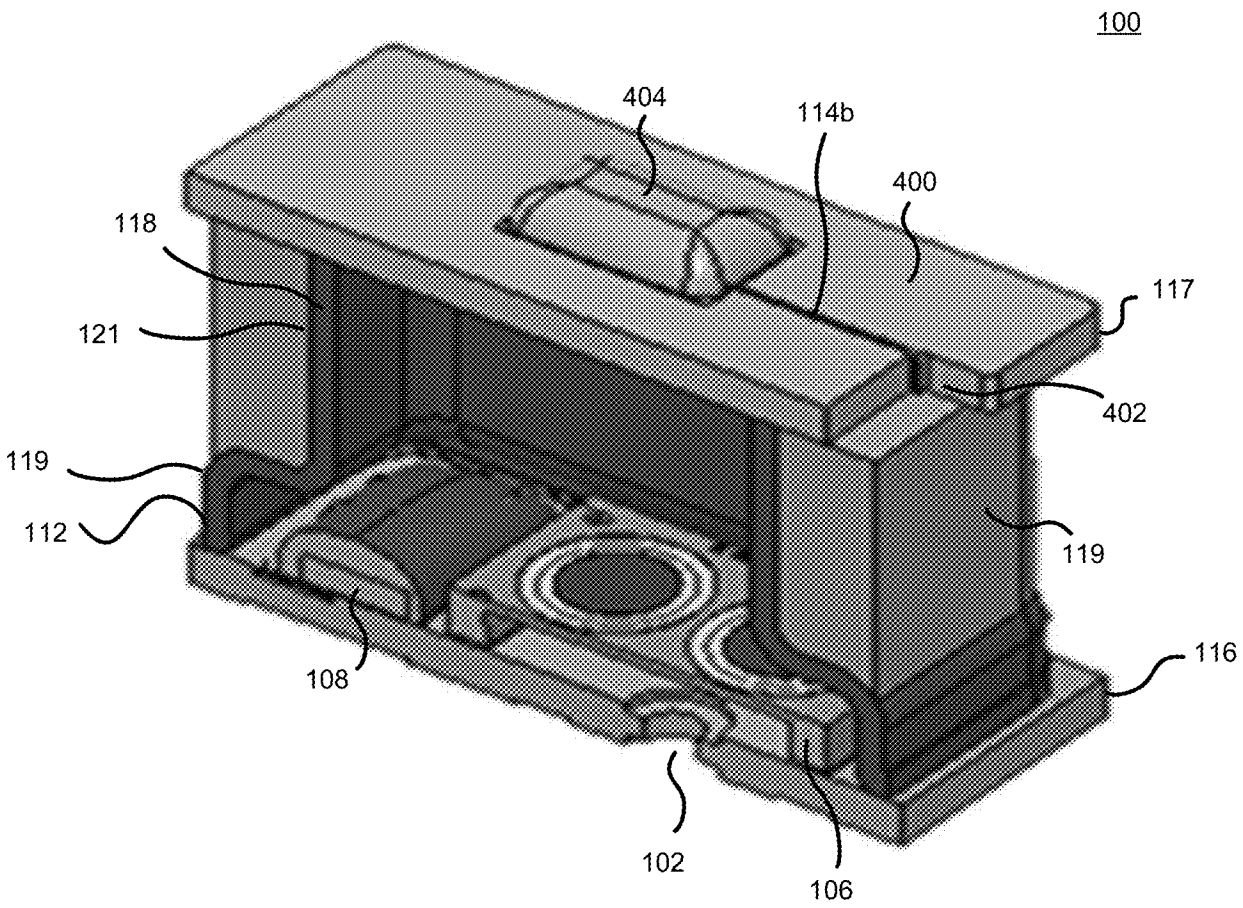
FIG. 4 is a cross-sectional view of a microphone assembly having a lid embodied as a terminal board.
Figure 5:
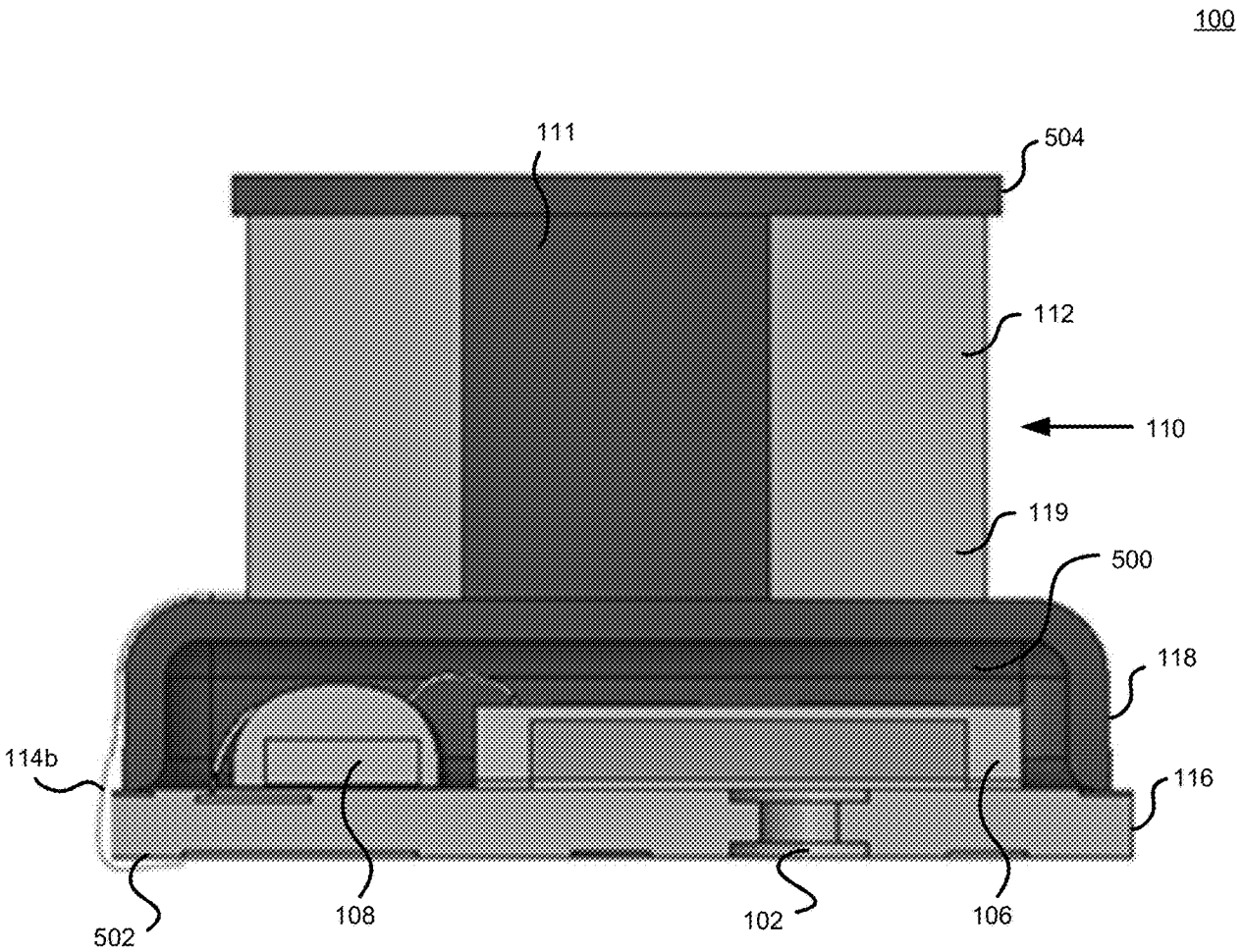
FIG. 5 is a cross-sectional view of a microphone assembly in accordance with another example set forth in the disclosure.
Figure 6:
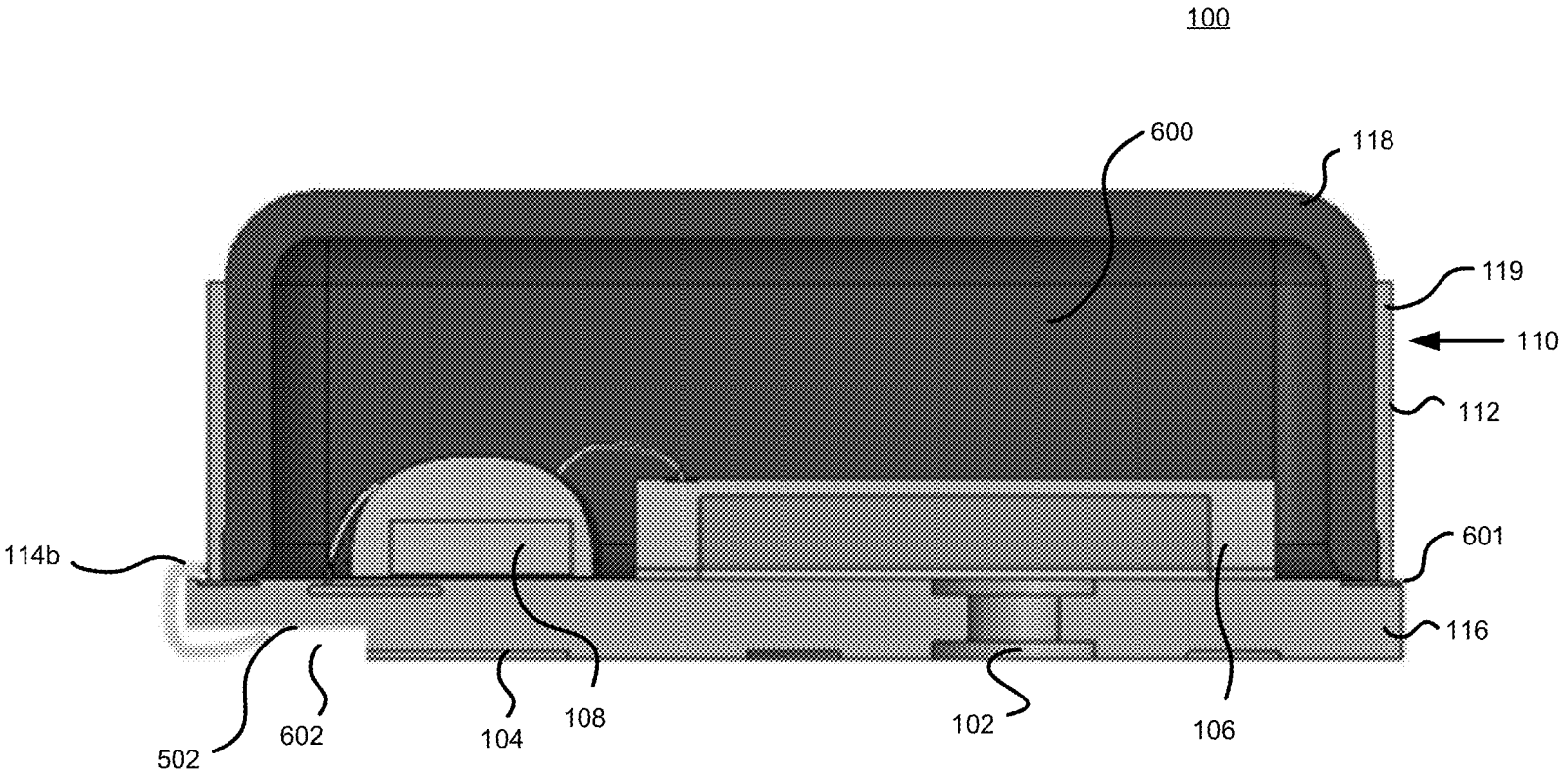
FIG. 6 is a cross-sectional view of a microphone assembly in accordance with yet another example set forth in the disclosure.
Figure 7:
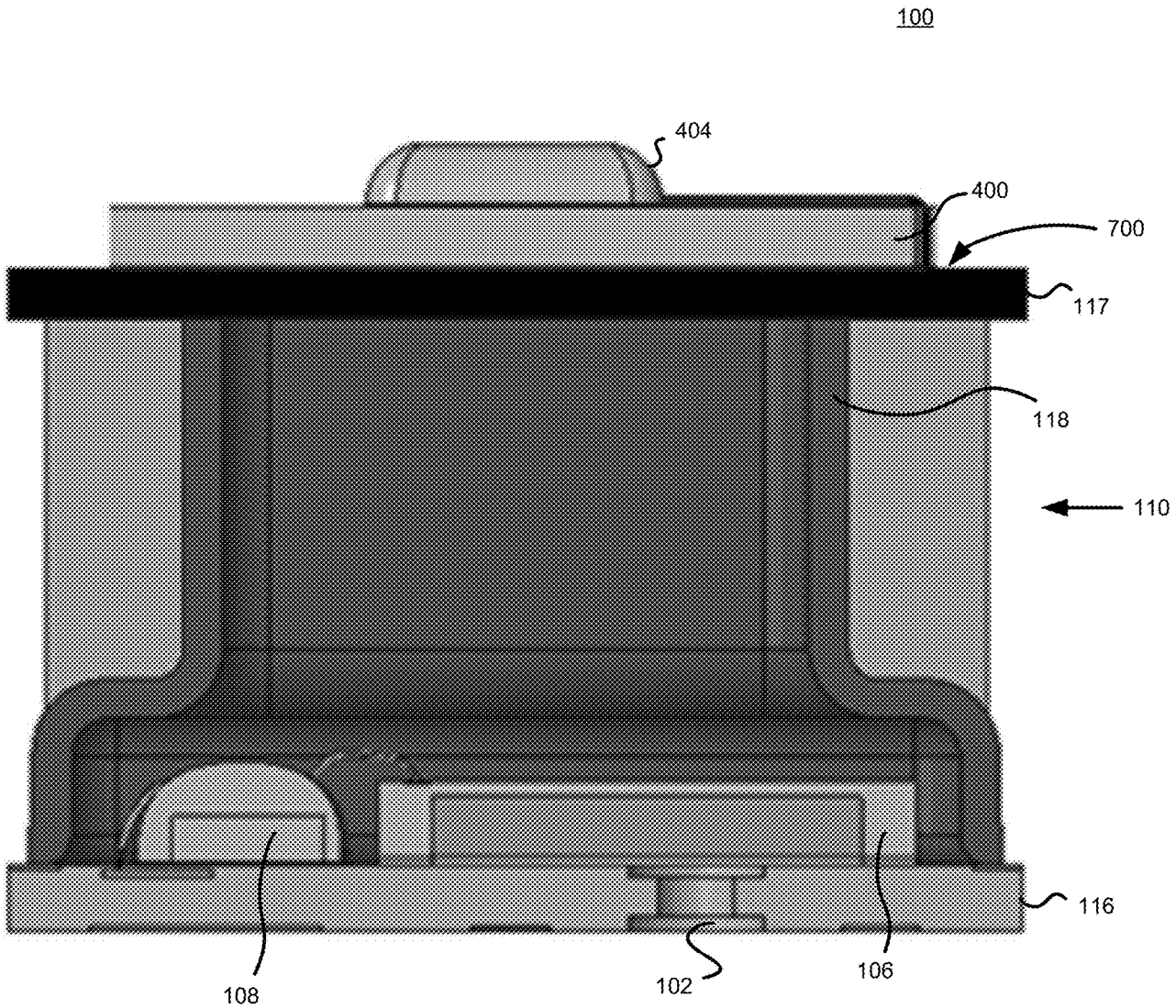
FIG. 7 illustrates a cross-section of a microphone assembly in accordance with still another example set forth in the disclosure.

In FIGS. 1-8, the housing 101 includes a base 116 and a can 118. In FIGS. 5 and 6, the can is a unitary member. In FIGS. 1-4, 7 and 8, the can is an assembly including can portion 118 and a lid 117 that forms a radial flange extending from the can. In FIGS. 1, 4 and 7, the can also has a flange portion 119 that extends radially away from a narrowed portion 121 of the can. The lid 117 and can portion 118 effectively form a bobbin that retains windings 119 of the coil. In FIGS. 5 and 6, the can 118 a unitary cup without a lid. The housing also includes a sound port. In FIGS. 1-8, the sound port 102 is disposed in the base. In other embodiments, alternatively, the sound port may be disposed on the top or sidewall of the can.

The microphone assembly also comprises an acoustic transducer disposed in the housing and in acoustic communication with the sound port. In FIGS. 1-8, the acoustic transducer 106 is disposed on a surface of the base over the sound port. In other embodiments however, the acoustic transducer may be disposed on the can or sidewall. In one embodiment, the acoustic transducer is a capacitive transducer comprising an electret material or electrodes fabricated as a microelectromechanical systems (MEMS) transducer. In other embodiments, the acoustic transducer is a piezoelectric transducer, among other known or future acoustic transducers suitable for use in microphone assemblies.

In some embodiments, an electrical circuit is disposed in the housing. The electrical circuit is electrically coupled to the acoustic transducer and to electrical contacts on the external-device interface. In FIGS. 1-8, the electrical circuit 108 is an integrated circuit (IC), like an application specific integrated circuit (ASIC), that conditions signals from one or both of an acoustic transducer or a magnetic transducer. In other embodiments, the electrical circuit includes one or more processors like a DSP that may be implemented as a separate IC or ASIC.

The magnetic transducer generally comprises an electrical coil 112 disposed about a core 111 wherein the magnetic transducer is fastened to the housing. In FIGS. 1-4 and 6-8, the electrical coil of the magnetic transducer is disposed about the housing, wherein the housing is the core. In FIG. 5, the electrical coil of the magnetic transducer is disposed about a core, other than the can, wherein the magnetic transducer is affixed to an outer surface of the housing. FIG. 5 shows the core 111 fastened to the housing of the microphone assembly. In this embodiment the can 118 may be made of a high or medium permeability metal and serve as an extension of the core. In embodiments where the magnetic transducer includes an air core, however, the magnetic transducer coil may be fastened to the housing in FIG. 5 using an epoxy or other fastening mechanism without the use of any core component.

Figure 2:
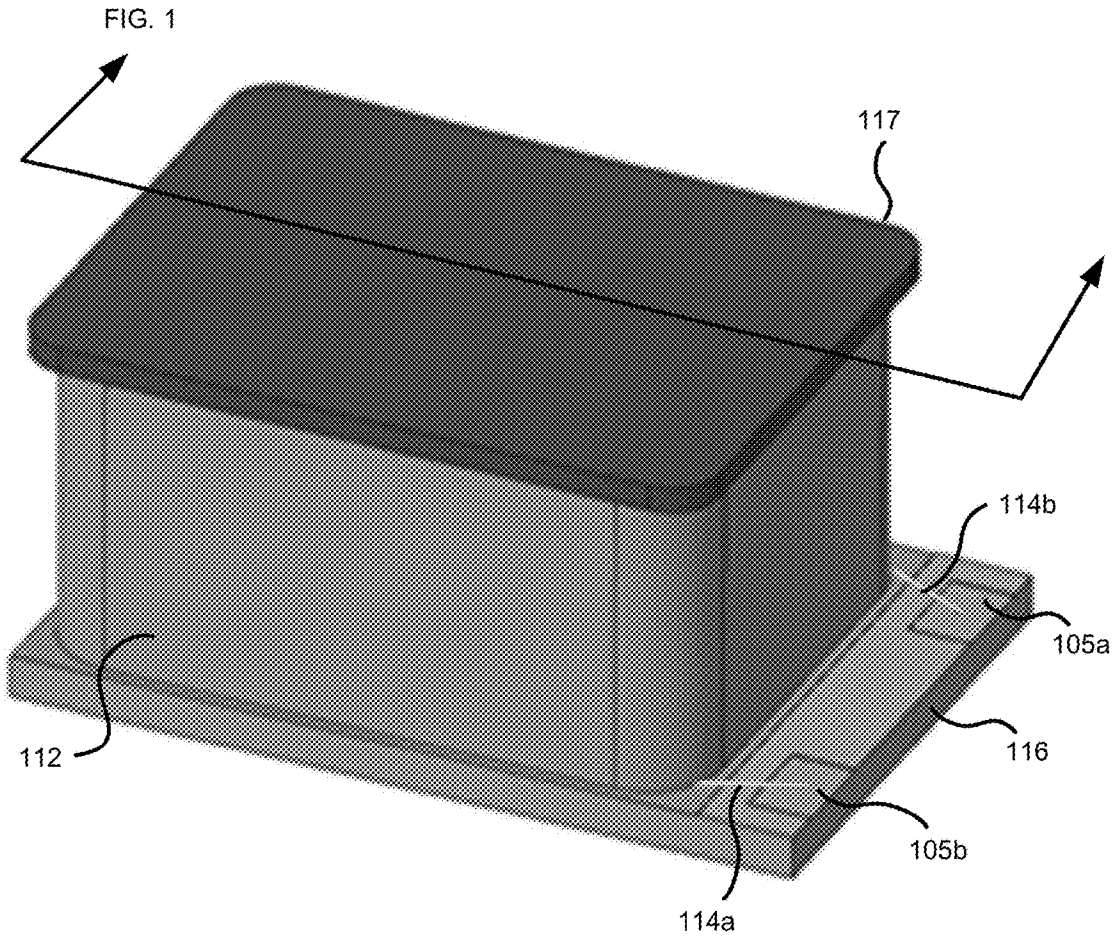
FIG. 2 is a perspective view of the microphone assembly of FIG. 1.

The electrical coil of the magnet transducer comprises two or more leads, at least one of which is terminated at a coil contact of the housing. In FIG. 2, leads 114*a* and 114*b* of the electrical coil are coupled to coil contacts 105*a* and 105*b*, respectively. FIG. 5 shows lead 114*b* of the electrical coil terminated at a coil contact embodied as an electrical contact 502 on the external-device interface of the microphone assembly. FIG. 6 shows lead 114*a* of the electrical coil terminated at a coil contact 502 in a recess 602 on the external-device interface. In FIG. 7, a lead of the electrical coil is terminated at a coil contact 404 disposed on a circuit board 400 located atop the microphone housing. While the magnetic transducer lead in FIG. 6 is shown wrapped around an outer edge of the base, alternatively, the lead may be coupled to the contact 502 via a conductor extending through the base as show in FIG. 1.

The output of the magnetic transducer may, or may not, be connected to the electrical circuit of the microphone assembly, depending on the use case. In wireless charging applications, the magnetic transducer is not coupled to the electrical circuit. In telecoil applications, the output of the magnetic transducer may be coupled to the electrical circuit of the microphone assembly or alternatively to a processor of a host device, like a hearing device in which the microphone assembly is integrated.

Figure 9:
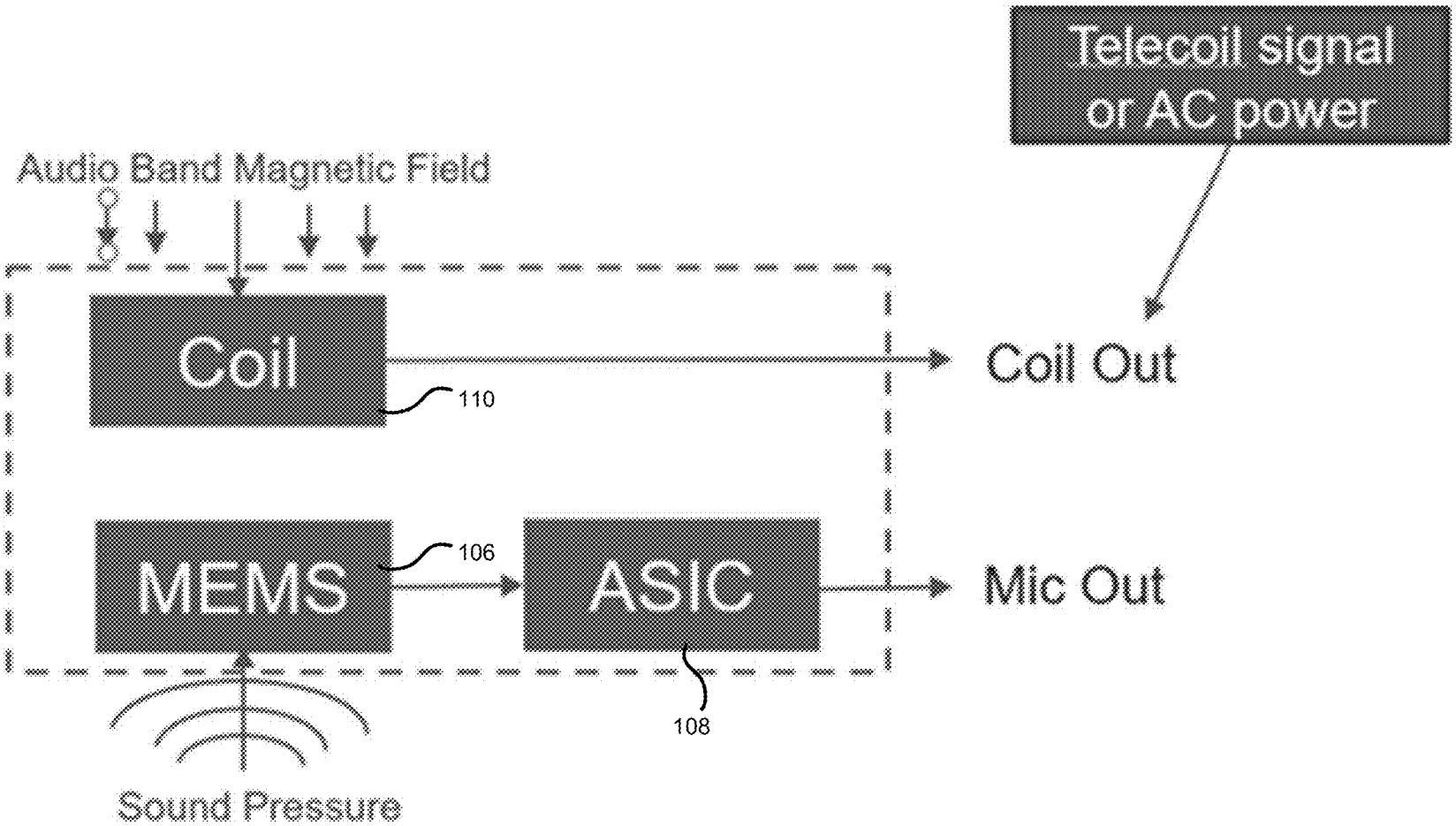
FIG. 9 is a block diagram illustrating a first circuit topology in a microphone assembly in accordance with at least one example set forth in the disclosure.

In FIG. 1, a via 115 extending through the base interconnects coil contact 105*a* on a top side of the base to a contact of the external-device interface on the bottom side of the case, shown as 104*d* in FIGS. 1 and 3. In FIGS. 4 and 7, the magnetic transducer is coupled to corresponding contacts 404, only one of which is shown, on the PCB board. Thus, configured the signal from the magnetic transducer is connected to the external interface of the microphone assembly. FIG. 9 shows a block diagram wherein the coil 110 of the magnetic transducer, configured as either a telecoil or a wireless charging coil, is coupled to an external interface of the microphone assembly.

In some applications where the magnetic transducer is configured as a telecoil, the magnetic transducer may be coupled to the electrical circuit. In FIGS. 2, 5, and 6 the leads of the magnetic transducer are coupled to the electrical circuit via corresponding coil contacts. The coil contacts may be coupled to traces on or in the base. Thus, configured the electrical circuit can receive and condition a signal form the telecoil. Such conditioning may include any one or more of buffering, amplification, filtering, analog-to-digital (A/D) conversion among other known or future processing.

Figure 10:
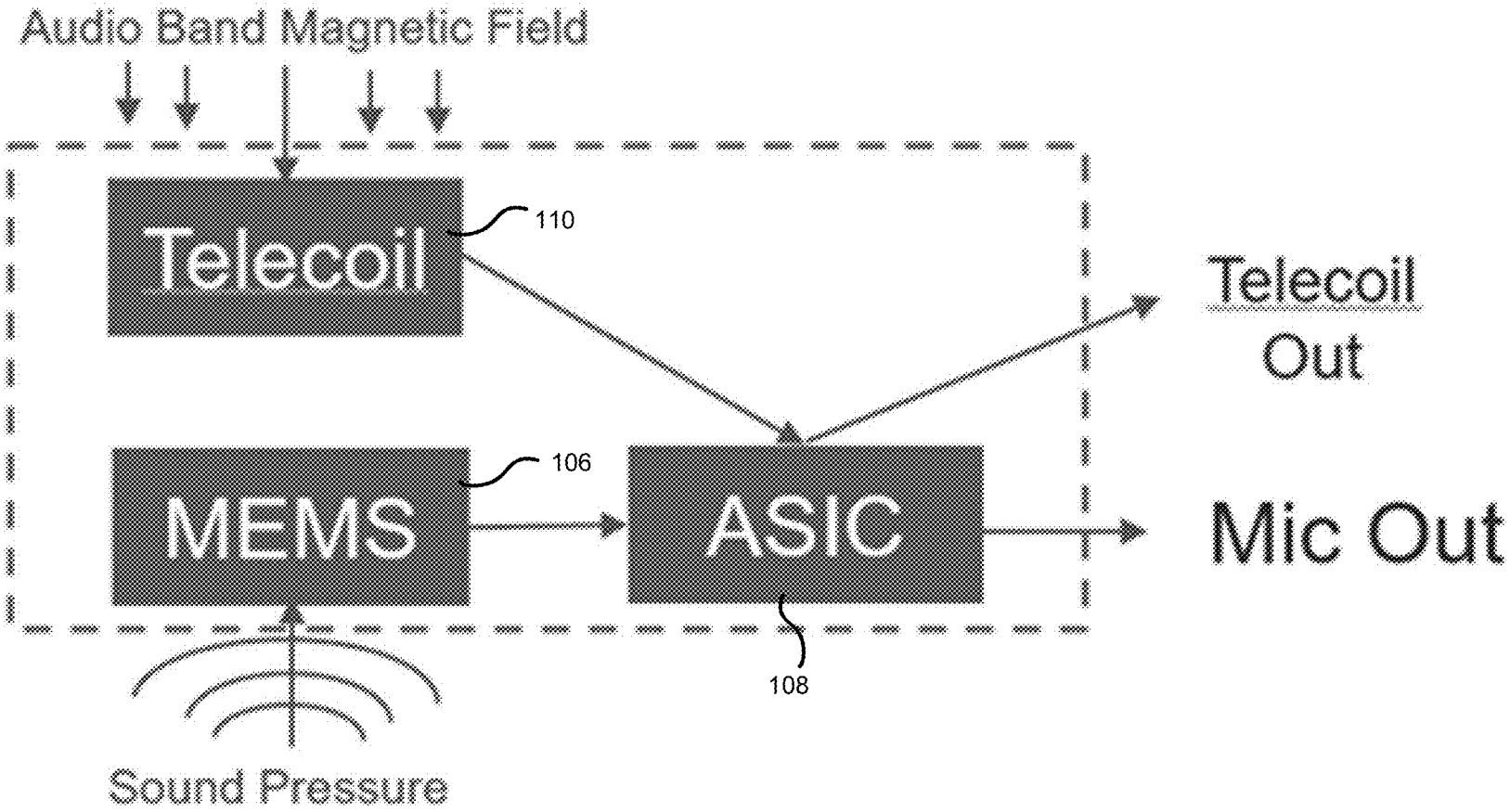
FIG. 10 is a block diagram illustrating a second circuit topology in a microphone assembly in accordance with at least one embodiment set forth in the disclosure.
Figure 11:
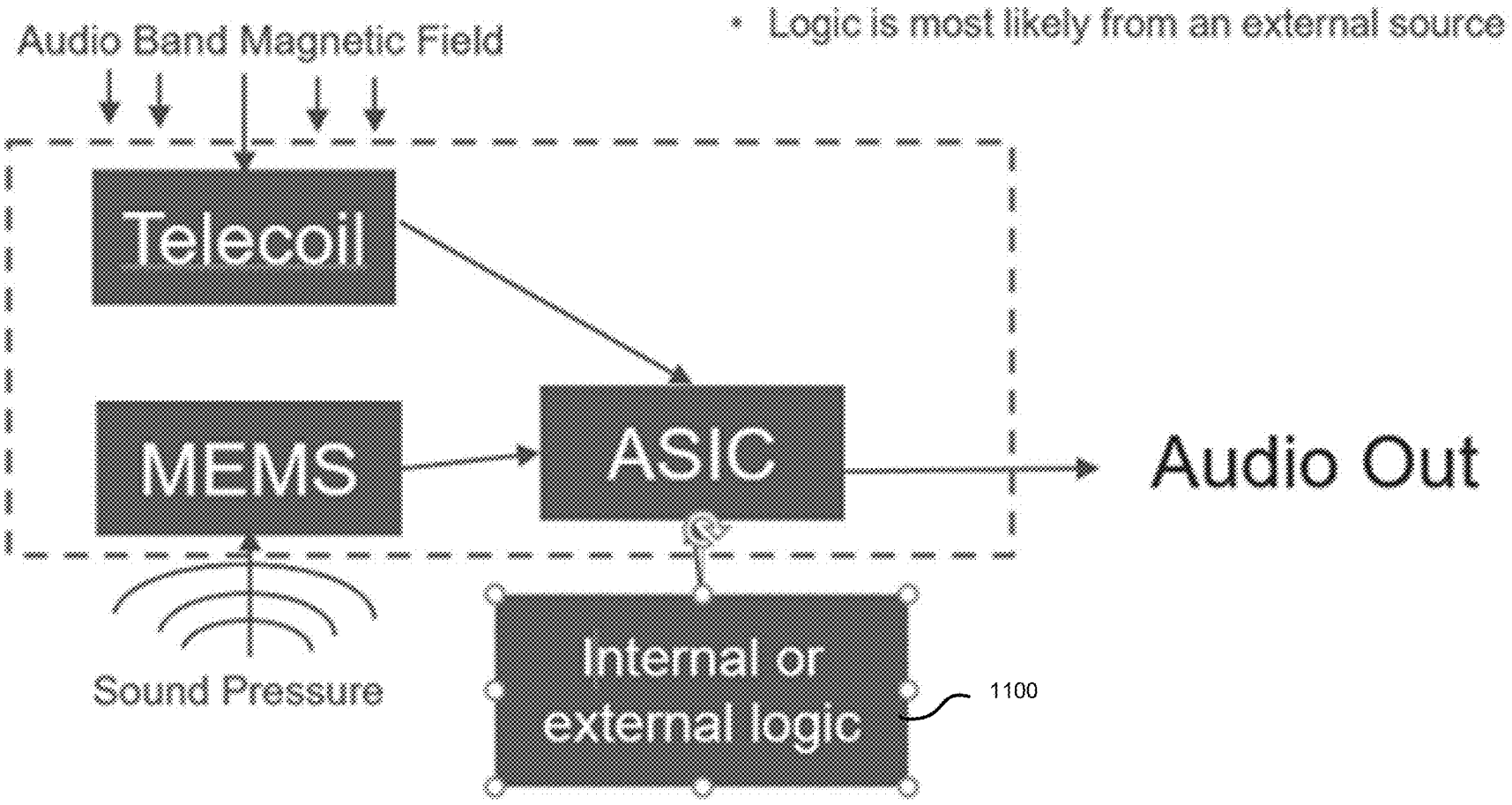
FIG. 11 is a block diagram illustrating a third circuit topology in a microphone assembly in accordance with at least one embodiment set forth in the disclosure.

FIGS. 10 and 11 show electrical schematics wherein the telecoil 110 is coupled to an ASIC 108. In FIG. 10, the microphone assembly has separate outputs for the telecoil signal and the acoustic transducer signal. Thus configured, the electrical circuit can provide either or both the telecoil signal or the acoustic transducer signal at the output of the microphone assembly. In FIG. 11, the microphone assembly has a common audio output for the telecoil signal and the acoustic transducer signal. Thus configured, the electrical circuit can provide the telecoil signal or the acoustic transducer signal, or a blend of these signals at the output of the microphone assembly under control of logic 1100. The control logic may come from a signal external to the microphone assembly or may be integral to the microphone assembly where logic decisions would be based on the sensed acoustic and magnetic signals.

In FIG. 4, a terminal board 117 is coupled to, and forms a lid for, can 118. In this example, the terminal board 400 includes a notch 402 that allows a coil lead 114*b* to terminate on the contact 404 of the terminal board. A similar notch is provided for other coil leads.

FIG. 5 illustrates an embodiment of a cross sectional view of a microphone assembly that provides coil wire termination closer to the integrated circuit and has the magnetic transducer attached to a can of an acoustic transducer. In this example, a back volume 500 for the microphone 100 is reduced compared to that shown in FIG. 1. In this example, there is more room for the metal core 111 and windings 119 for the magnetic transducer, such as a telecoil, due to the reduced internal air volume. In this example, the coil wire 114*a* is bonded to pad 502 on the bottom of the base 116. The same structure is used for the coil wire 114*b*. In this example a coil retention flange 504 is on an end of the core. The width of the PCB can be reduced in this example because there are not extra pads on the top of the PCB (e.g., the base compared for example to FIG. 1).

In FIG. 6, the microphone assembly 100 comprises a magnetic transducer wherein the coil is wound around an outer periphery of the can 118. In this example, there is no coil retention flange and no lid. In this example, a more compact design is presented that may be useful for a charging coil where fewer windings may be needed. The width of the board can be reduced because there are not extra pads on top of the board as compared, for example, to FIG. 1.

In FIG. 7, the microphone assembly 100 comprises a terminal board 400 including a contact 404 fastened to a lid 117 of the can 118. In this example, the width and length of the base is similar to that illustrated in FIG. 4 and there magnetic transducer lead is terminated at contact 404. In this example, the lid 117 includes a passthrough 700 to allow the coil lead to pass up through the terminal board 400. In FIG. 4, the terminal board 400 has a ground plane lid 117 soldered to a top of the can for electromagnetic shielding of the microphone components.

Figure 8:
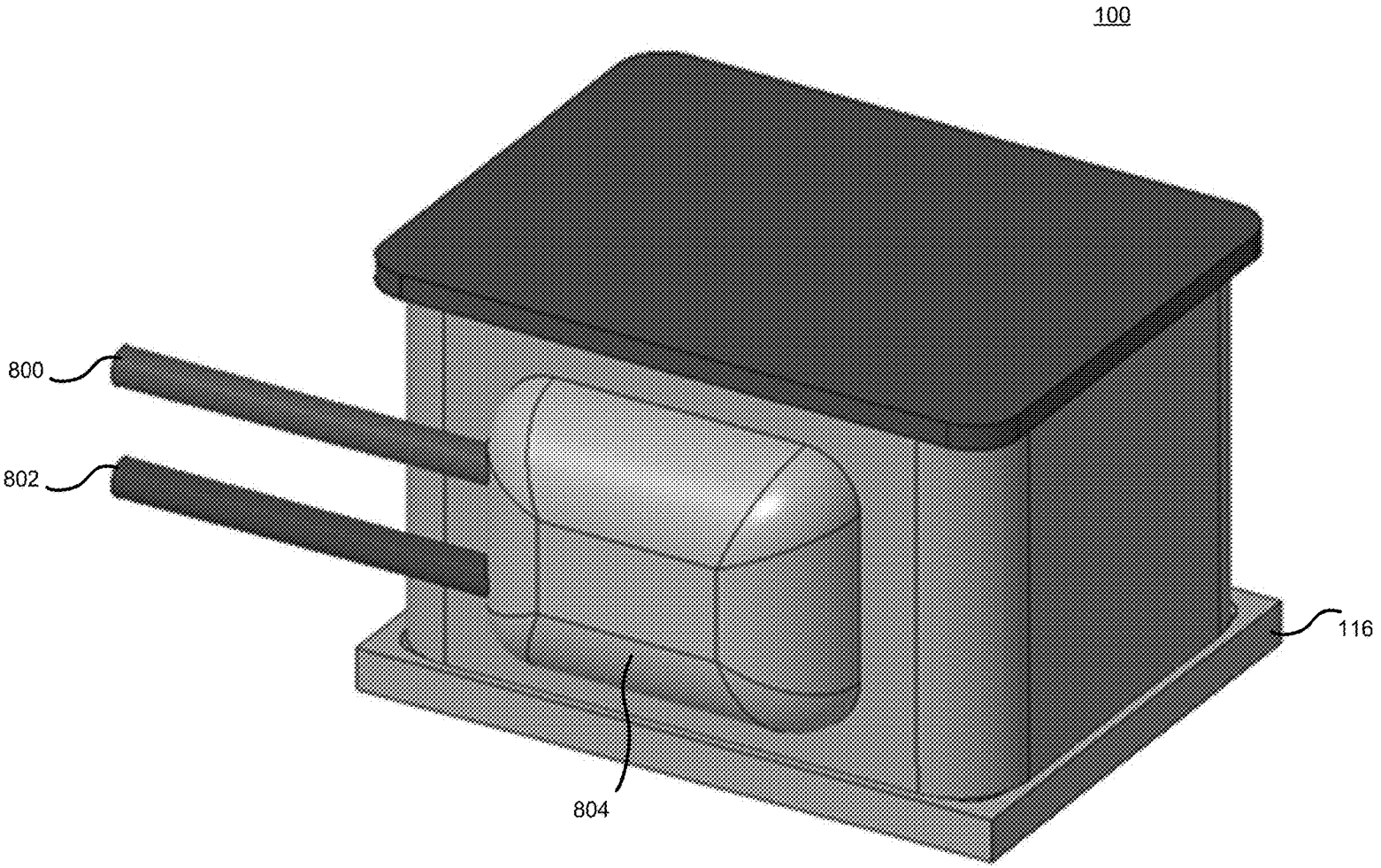
FIG. 8 is a perspective view of a microphone assembly having coil leads connected to wires in accordance with one example set forth in the disclosure.

FIG. 8 illustrates another example of a microphone assembly 100 comprising a magnetic transducer wound around a housing of the microphone assembly wherein leads of the coil are coupled to larger termination wires 800 and 802 through an operation that may include pig tailing the coil wires to the termination wires before soldering. In this example, a glue blob 804 covers the solder joints that join the coil wires to the termination wires and the coil leads. The base 116 in this example is smaller than the base shown in FIG. 1 since the coil leads are not terminated on the base.

Figure 12:
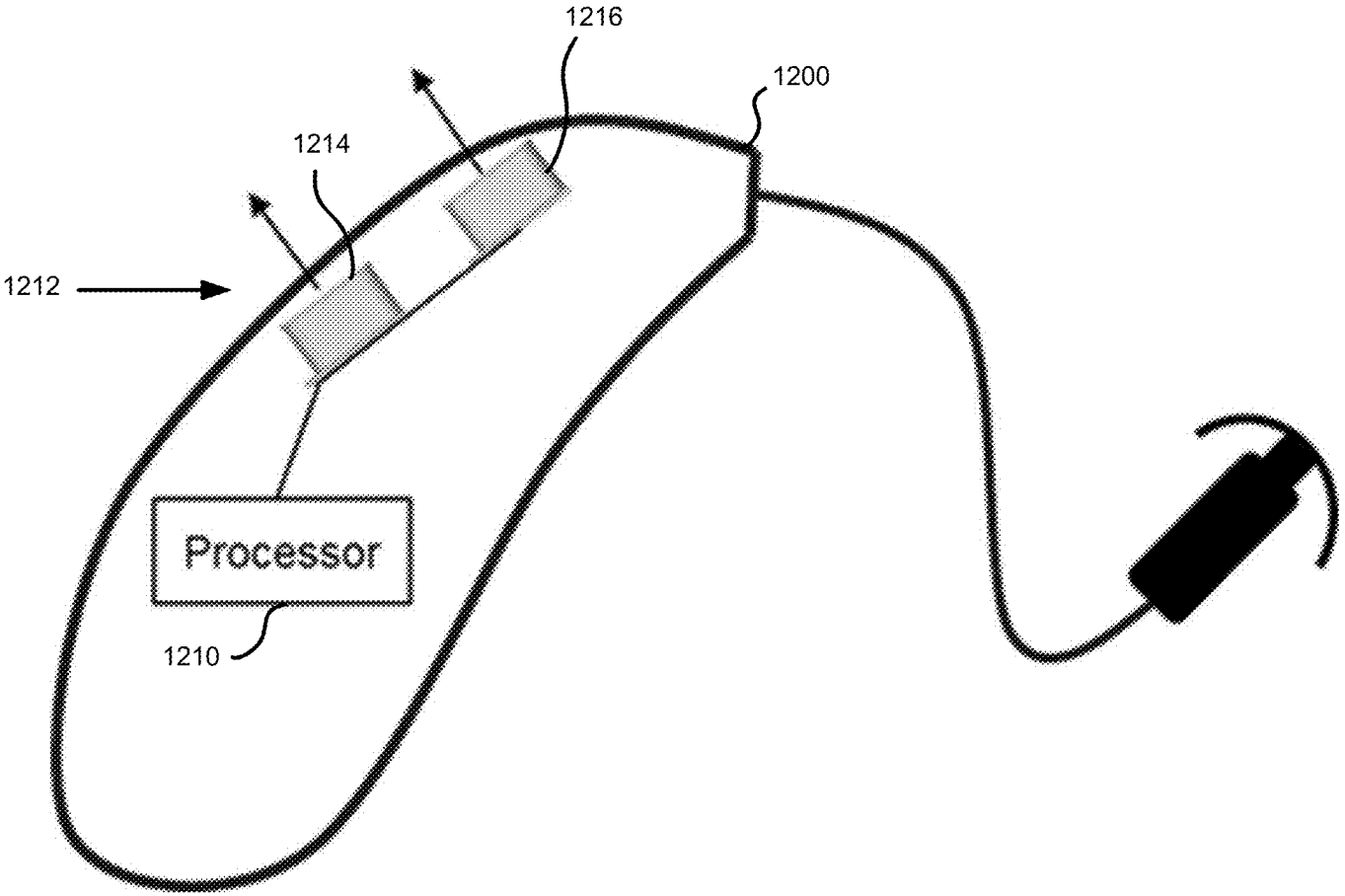
FIG. 12 is a diagram illustrating a hearing device having a plurality of magnetic transducers having axes in parallel in accordance with one example set forth in the disclosure.

FIG. 12 illustrates one example of a hearing device such as hearing aid, ear buds, hearables, ear phones, or other hearing device worn on or in the ear. The hearing device includes a housing 1200, a processor 1210 disposed in the housing and a network of telecoils 1212 that are electrically coupled to the processor. Each telecoil 1214 and 1216 are integrated with a corresponding microphone assembly as previously described with respect to one or more of FIGS. 1-8. The microphone assemblies are spatially separated and disposed at least partially within the housing 1200. The network of telecoils 1212 improve overall sensitivity of the hearing device. In this example, the axes of the telecoils 1214 and 1216 are parallel such that sensitivity of the hearing device is increased. In one embodiment, the overall sensitivity of the telecoil system in this example may be increased by two times where the two telecoils are aligned and pointing in the same direction.

Figure 13:
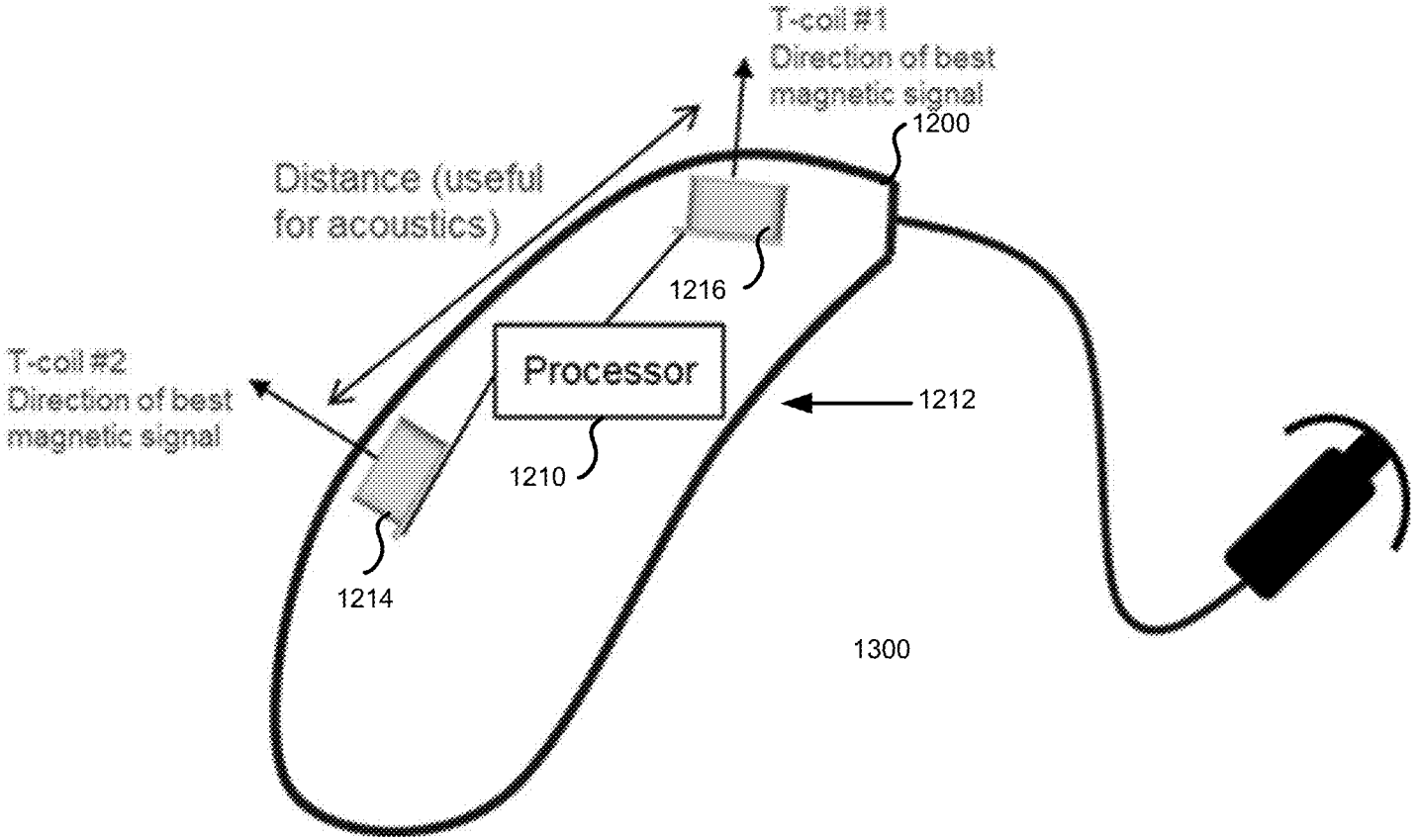
FIG. 13 is a diagram illustrating a hearing device that includes a plurality of magnetic transducers having axes that are non-parallel in accordance with one example set forth in the disclosure.

FIG. 13 illustrates one example of a hearing device 1300 that employs improved directional sensitivity through the network of telecoils 1212 wherein each telecoil is integrated with a corresponding microphone as previously described above with reference to one or more of FIGS. 1-8. The telecoils are spatially separated and disposed at least partially within the housing 1200. In this example, the axes of the telecoils 1214 and 1216 are non-parallel. As such, the directional sensitivity dependency of the network of the telecoils is decreased.

The angular difference between the microphones in this example creates a phased array. The signals from the two telecoils is summed by the processor and the overall directional sensitivity of the phase array is reduced. The two telecoils may also be summed by connecting them in series before the combined signal reaches the processor. By way of example, hearing aids frequently have two microphones per ear for beam forming the acoustic signal to determine the direction that the sound is coming from.

Figure 14:
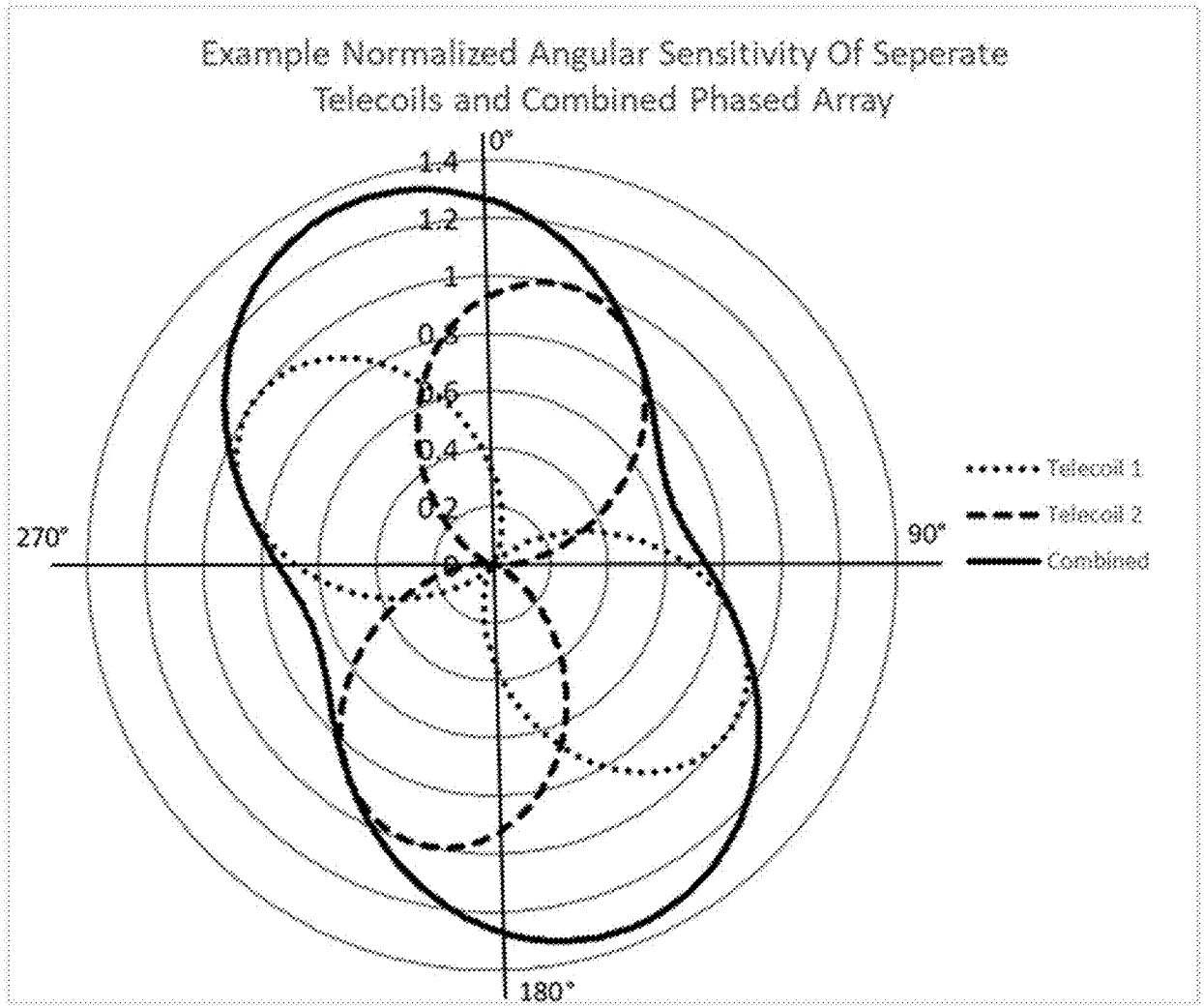
FIG. 14 is a diagram illustrating a normalized angular sensitivity of a plurality of magnetic transducers in accordance with one example set forth in the disclosure.

FIG. 14 is a diagram illustrating an example of normalized angular sensitivity of separate telecoils and combined phased array shown in FIG. 13. In one embodiment, the network of telecoils 1212 are positioned in the housing 1200 to affect the shown sensitivity.

In implementations where the magnetic transducer is configured as a telecoil, a high conductivity fine gauge copper wire or other appropriate material is employed to form a coil with likely thousands of turns. In another implementation where the coil is configured as a charging coil, such as for charging a battery or other chargeable component, tens or hundreds of turns are likely employed for the coil.

In some implementations, the can and lid are made of a medium or high permeability material, such as for a telecoil application. In some implementations, the cup and lid or core are a mu metal 80/20 nickel iron alloy. However, any suitable materials may be employed. High permeability metal in some implementations improves the performance of the telecoil by increasing the telecoil sensitivity compared to stainless steel or air. In other implementations, cast ferrite may also be employed, for example, in a charging coil application. In some implementations, both the lid and cup are plated with gold for high electrical conductivity to provide electromagnetic shielding, however other implementations need not have such material. As shown in some implementations, the application specific integrated circuit or other circuitry is encased with an epoxy and wire bonded to the transducer to receive signals from the transducer. In some implementations where the coil is configured as a charging coil, the can is stainless steel.

In one embodiment, the microphone assembly 100 employs a microphone circuit board subassembly and lid/can subassembly. The microphone subassembly is assembled by assembling the microphone components and integrated circuit(s) to the base using standard processes such as surface mount assembly processes such that the microphone and ASIC or other integrated circuit are affixed to the base. In some implementations, the base includes a metal ring that is coupled to ground and is configured in a shape to correspond to a shape of a base of the can.

For the can subassembly, the lid is attached to the can through a seam welding process, high temperature soldering process, spot weld and glue process or any other suitable process that provides an acoustic seal between the lid and the can. The lid/can subassembly is assembled to the microphone circuit board assembly through a high temperature solder process, in some examples in a solder process that is a lower temperature from the cup to lid solder process. For example, the lid/can subassembly is aligned to the corresponding metal ring on the base and soldered to the base. An additional welding operation may be employed if desired. Each microphone assembly is then separated from a larger board array and the microphone may undergo testing for performance. The assembly process includes winding the wire around the cup or core and terminating the coil leads to a coil contact on the printed circuit board (e.g., base) such as using a local spot weld or wire bonding process. In other implementations, a high temperature solder or conductive epoxy process may be used. It will be recognized that any suitable attachment process may be employed.

In certain implementations, such as for telecoil configurations, the can is made from a high permeability magnetic alloy as opposed to conventional cans that employ stainless steel or brass. The high permeability magnetic alloy in some implementations helps to pull in magnetic flux from an AC magnetic field to facilitate a telecoil operation. In implementations where the coil is configured as the charging coil, the high permeability magnetic alloy need not be employed, and stainless steel or other suitable material may be employed. In some implementations, an AC magnetic field going through the middle of the coil generates a voltage in the coil. For a telecoil operation, the AC field may be in the audio band and the resistance of the coil in some implementations is on the order of 1,000 ohms or any other suitable resistance. The number of turns in some implementations is high such as in the thousands of turns range but any suitable number of turns may be employed. The wire gauge in some implementations is 56 which is about 0.015 mm diameter, however any suitable wire gauge may be employed.

For charging coil configurations, the AC field in some implementations is 100-400 kHz, and the resistance of the coil is on the order of ohms or tens of ohms. However, any suitable resistance or frequency may be configured. The number of turns are also less in a charging coil implementation than in a telecoil implementation. In some implementations, the wire gauge is heavier than the telecoil implementation and in some implementations is a 48-gauge wire, however any suitable size wire may be employed.

Among other advantages, employing an integrated coil with a microphone assembly provides a compact design. Employing magnetic transducers provides for an integrated assembly which provides an advantageous form factor. Other benefits will be recognized by those of ordinary skill in the art.

While the present disclosure and what is presently considered to be the best mode thereof has been described in a manner that establishes possession by the inventors and that enables those of ordinary skill in the art to make and use the same, it will be understood and appreciated that there are myriad modifications, variations and equivalents thereto, all of which are within the scope and spirit of the disclosure, which is to be limited not by the exemplary embodiments but by the appended claims.

The invention claimed is:

1. A micro electromechanical systems (MEMS) microphone assembly comprising:

a microphone assembly housing including a sound port and an external-device interface having a plurality of electrical contacts;

an acoustic MEMS transducer disposed in the housing and in acoustic communication with the sound port;

an electrical circuit disposed in the housing, the electrical circuit electrically coupled to the acoustic transducer and to electrical contacts on the external-device interface, a magnetic transducer including an electrical coil disposed about a metal portion of the microphone assembly housing, the electrical coil having leads, at least one of the leads electrically terminated at a coil contact of the housing.

2. The assembly of claim 1, the microphone assembly housing comprising a base and a can coupled to a first surface of the base, the external-device interface disposed on a second surface of the base, opposite the first surface, wherein the electrical coil of the magnetic transducer is wound about the can.

3. The assembly of claim 2, wherein the can is metal having a medium or high permeability and the magnetic transducer is a telecoil and the at least one lead of the electrical coil is electrically coupled to the electrical circuit via the coil contact.

4. The assembly of claim 3, wherein the electrical circuit is configured to condition a signal of the magnetic transducer.

5. The assembly of claim 4, the electrical circuit is configured to output a signal, based on input from the MEMS transducer or the telecoil or a blend of both the telecoil and the MEMS transducer, to a contact of the external-device interface.

6. The assembly of claim 2, wherein the coil contact is disposed on the first surface of the base.

7. The assembly of claim 6 further comprising a conductor directly electrically connecting the coil contact to a contact on the external-device interface.

8. The assembly of claim 7, wherein the magnetic transducer is configured as a wireless charging device.

9. The assembly of claim 7, wherein the magnetic transducer is configured as a telecoil.

10. The assembly of claim 2 further comprising a terminal board coupled to the can, wherein the coil contact is disposed on the terminal board.

11. A microphone assembly comprising:

a microphone assembly housing including base, a metal can coupled to a first surface of the base, and an external-device interface having a plurality of electrical contacts on a second surface of the base opposite the first surface;

an acoustic microelectromechanical systems (MEMS) transducer disposed in the housing and in acoustic communication with a sound port of the housing;

an electrical circuit disposed in the housing, the electrical circuit electrically coupled to the acoustic transducer and to electrical contacts on the external-device interface;

a magnetic transducer including an electrical coil disposed about a core with medium or high magnetic permeability, the magnetic transducer fastened to the housing, the electrical coil having leads, at least one of the leads electrically coupled to the electrical circuit, wherein the metal can is the core about which the electrical coil is disposed.

12. The assembly of claim 11, wherein the electrical circuit is an integrated circuit, the external-device interface is a surface-mount interface, and the integrated circuit is configured to condition a signal of the magnetic transducer.

13. The assembly of claim 11, the electrical circuit configured to output a signal based on input from the MEMS transducer or the magnetic transducer, to a contact of the external-device interface.

14. The assembly of claim 11, the electrical circuit configured to output a blended signal, based on input from the MEMS transducer and the magnetic transducer, to a contact of the surface-mount interface.

15. The assembly of claim 11, wherein the electrical coil comprises a telecoil and a wireless charging coil having leads electrically coupled to corresponding contacts on the base.

* * * * *